US010683137B2

(12) United States Patent
Hawry

(10) Patent No.: US 10,683,137 B2
(45) Date of Patent: Jun. 16, 2020

(54) CONTAINER TRAY ASSEMBLY WITH CHILD RESISTANT SLEEVE

(71) Applicant: Berlin Packaging, LLC, Chicago, IL (US)

(72) Inventor: Liam Hawry, Chicago, IL (US)

(73) Assignee: Berlin Packaging, LLC, Chicago, IL (US)

( * ) Notice: Subject to any disclaimer, the term of this patent is extended or adjusted under 35 U.S.C. 154(b) by 108 days.

(21) Appl. No.: 16/156,027

(22) Filed: Oct. 10, 2018

(65) Prior Publication Data

US 2020/0115102 A1 Apr. 16, 2020

(51) Int. Cl.

| | |
|---|---|
| ***B65D 21/08*** | (2006.01) |
| ***A61J 1/03*** | (2006.01) |
| ***B65D 1/34*** | (2006.01) |
| ***B65D 50/00*** | (2006.01) |

(52) U.S. Cl.

CPC ..... *B65D 21/086* (2013.01); *A61J 1/03* (2013.01); *B65D 1/34* (2013.01); *B65D 50/00* (2013.01)

(58) Field of Classification Search

CPC ..... B65D 21/086; B65D 50/00; B65D 1/34; B65D 21/08; B65D 81/32; B65D 83/04; B65D 2585/56; A61J 1/03; A61J 3/00–10; A61J 1/2051; A61J 1/00

USPC ..... 220/23.83, 23.86, 8, 495.01, 495.05; 206/528–540, 499, 557, 562

See application file for complete search history.

(56) References Cited

U.S. PATENT DOCUMENTS

| | | | | |
|---|---|---|---|---|
| 2,377,120 | A | 3/1932 | Apfelbaum | |
| 2,236,224 | A | 3/1939 | Raschkind | |
| 2,353,629 | A * | 7/1944 | Apfelbaum | B65D 47/283 206/536 |
| 2,751,135 | A | 5/1953 | Kessler | |
| 2,857,070 | A | 10/1958 | Elias | |
| 2,935,180 | A * | 5/1960 | Von Martens | A61J 1/03 206/535 |
| 3,262,747 | A | 7/1966 | Kotzek et al. | |
| 3,270,915 | A * | 9/1966 | Auer | B65D 83/0418 221/2 |
| 3,395,849 | A | 8/1968 | Gillam | |
| 3,579,883 | A * | 5/1971 | Hayes | A61J 7/04 40/107 |
| 3,612,348 | A * | 10/1971 | Thomas | A61J 7/04 221/2 |
| 3,648,918 | A | 3/1972 | Van Inwagen | |
| 3,749,230 | A | 7/1973 | Foster | |
| 3,782,584 | A | 1/1974 | Swenson et al. | |

(Continued)

FOREIGN PATENT DOCUMENTS

| | | |
|---|---|---|
| CN | 105012141 | 11/2015 |
| CN | 104648749 | 10/2017 |

(Continued)

*Primary Examiner* — Kareen K Thomas

(74) *Attorney, Agent, or Firm* — Adam K. Sacharoff; Much Shelist, P.C.

(57) ABSTRACT

In one embodiment there is provided a container tray assembly configured to hold a substance and including a container tray and sleeve. A small gap created between the outside profile of the container tray and the interior profile of the sleeve and the sleeve being deformable allows a user to squeeze the sleeve to permit the container tray to slid with respect to the sleeve and therefore allowing the user to gain access to a container tray interior cavity.

9 Claims, 25 Drawing Sheets

(56) References Cited

U.S. PATENT DOCUMENTS

| | | | | |
|---|---|---|---|---|
| 3,833,143 | A | 9/1974 | Starkermann et al. | |
| 3,888,350 | A | 6/1975 | Horvath | |
| 3,894,654 | A | 7/1975 | Frankenberg | |
| 3,987,891 | A | 10/1976 | Horvath | |
| 4,043,448 | A | 8/1977 | Tanaka | |
| 4,113,098 | A | 9/1978 | Howard | |
| 4,126,224 | A | 11/1978 | Laauwe et al. | |
| 4,174,034 | A | 11/1979 | Hoo | |
| 4,284,204 | A | 8/1981 | Carey, Jr. | |
| 4,364,488 | A | 12/1982 | Anjou | |
| 4,401,210 | A | 8/1983 | Anjou | |
| 4,561,544 | A | 12/1985 | Reeve | |
| 4,817,819 | A | 4/1989 | Kelly | |
| 4,844,284 | A | 7/1989 | Drozd et al. | |
| 4,890,742 | A | 1/1990 | Allison | |
| 4,971,203 | A * | 11/1990 | Weinstein | B65D 83/0481 206/536 |
| 5,080,222 | A | 1/1992 | McNary | |
| 5,082,137 | A | 1/1992 | Weinstein | |
| 5,141,129 | A * | 8/1992 | Jennings | B65D 50/061 206/536 |
| 5,275,291 | A | 1/1994 | Sledge | |
| 5,620,109 | A | 4/1997 | Madden | |
| 5,878,887 | A | 3/1999 | Parker et al. | |
| 5,915,558 | A | 6/1999 | Girvetz | |
| 5,950,816 | A | 9/1999 | Reid | |
| 6,021,901 | A | 2/2000 | Wolfe | |
| 6,173,838 | B1 | 1/2001 | Brozell | |
| 6,230,917 | B1 | 5/2001 | Whitnell | |
| 6,460,693 | B1 | 10/2002 | Harrold | |
| D456,729 | S | 11/2002 | Nishimura | |
| 6,491,211 | B1 | 12/2002 | Evans et al. | |
| 6,557,700 | B1 | 5/2003 | Wharton | |
| 6,662,081 | B1 | 12/2003 | Jacober et al. | |
| 6,789,677 | B2 | 9/2004 | Maietta | |
| 6,926,166 | B1 * | 8/2005 | Bitton | A45D 34/06 206/823 |
| 7,090,079 | B2 | 8/2006 | Ehrlund | |
| 7,464,819 | B2 | 12/2008 | Maietta | |
| 7,581,642 | B2 | 9/2009 | Knutson et al. | |
| 7,588,149 | B2 | 9/2009 | Gelardi | |
| 7,591,372 | B2 | 9/2009 | Gelardi et al. | |
| 7,617,935 | B2 | 11/2009 | Reilley et al. | |
| 7,708,142 | B2 | 5/2010 | Ehrlund | |
| 7,757,843 | B2 | 7/2010 | Katsis | |
| 7,854,325 | B2 | 12/2010 | Bentele | |
| 7,946,450 | B2 | 5/2011 | Gelardi et al. | |
| 7,967,144 | B2 | 6/2011 | Sack et al. | |
| 8,066,121 | B2 | 11/2011 | Sack et al. | |
| 8,066,123 | B2 | 11/2011 | Gelardi | |
| 8,162,144 | B2 | 4/2012 | Intini | |
| 8,205,752 | B2 | 6/2012 | Sack et al. | |
| 8,281,930 | B2 | 10/2012 | Lee et al. | |
| 8,359,816 | B2 * | 1/2013 | Guschke | A61J 1/03 53/170 |
| 8,453,840 | B2 | 6/2013 | Wharton | |
| 8,474,624 | B2 * | 7/2013 | Cronin | B65D 50/046 206/1.5 |
| 8,499,936 | B2 | 8/2013 | Albrecht et al. | |
| 8,523,011 | B2 * | 9/2013 | Haas | B65D 83/0418 206/540 |
| 8,602,218 | B2 | 12/2013 | Grosskopf | |
| 8,672,134 | B2 | 3/2014 | Sprada et al. | |
| 8,936,188 | B2 | 1/2015 | Mazurek | |
| 9,060,919 | B2 | 6/2015 | Babineau | |
| 9,248,935 | B2 | 2/2016 | Bailey et al. | |
| 9,346,594 | B2 | 5/2016 | Pipes et al. | |
| 9,452,877 | B2 | 9/2016 | Grosskopf | |
| 9,725,206 | B2 | 8/2017 | Linssen | |
| 9,926,125 | B2 | 3/2018 | Whitehurst | |
| 9,938,042 | B1 | 4/2018 | Aryanpanah et al. | |
| 9,981,788 | B2 | 5/2018 | Skinner | |
| 9,994,353 | B2 | 6/2018 | Patwardhan et al. | |
| 2004/0055903 | A1 | 3/2004 | Nishimura | |
| 2007/0045150 | A1 | 3/2007 | Huffer et al. | |
| 2007/0251983 | A1 | 11/2007 | Freeze | |
| 2011/0067363 | A1 * | 3/2011 | Sprada | B65D 83/0463 53/492 |
| 2011/0114512 | A1 | 5/2011 | Gelardi | |
| 2014/0339121 | A1 | 11/2014 | Gelardi et al. | |
| 2017/0119044 | A1 | 5/2017 | Oligschlaeger et al. | |
| 2017/0166365 | A1 | 6/2017 | Kidd | |
| 2018/0257827 | A1 | 9/2018 | Drosos et al. | |

FOREIGN PATENT DOCUMENTS

| | | |
|---|---|---|
| GB | 1494313 | 12/1977 |
| JP | 2000118578 | 4/2000 |
| JP | 2006001615 | 1/2006 |
| JP | 2008074414 | 4/2008 |
| WO | 199424008 | 10/1994 |
| WO | 200115998 | 3/2001 |
| WO | 2010015638 | 2/2010 |
| WO | 2018128188 | 12/2018 |

* cited by examiner 23.20
19.40
105
205
300

105
205
100

13.40
105
108.18
105
205
100

C
C
105
205
100

12.65
SECTION 7C-7C

105

108.18
2.14
105

8C
8C
2.47
1.20

105
SECTION 8C-8C
0.50°
0.50°
0.50°
0.50°
12
12.55
19.40
105

500
505
14
108.30
104.60
19C

SECTION 19C-19C

13

56.60
60

SECTION 20a-20a 108.30
30.30
2.25
2.97
1.20
13
56.60
57.60
R1.60
0.30°
0.60°
20a
20c
50S
50C 60
60C
1
1
21C
31.60
104.60
2.30
60C 10.05
21C 60C
14
SECTION 21C-21C

13

85
85
58

CONTAINER TRAY ASSEMBLY WITH CHILD RESISTANT SLEEVE

FIELD OF THE INVENTION

The present invention relates generally to container tray assemblies and more specifically to a container tray assembly having a removable sleeve.

BACKGROUND OF THE INVENTION

Container tray assemblies typically include a tray for containing a pharmaceutical or nutritional product. The tray assemblies are often not "child-resistant" and may be easy to access. It is therefore as aspect of one or more embodiments of this invention to provide an improved container tray assembly that has a child-resistant sleeve to prevent easy access into the tray and its contents. However, it is equally important to ensure that seniors can gain access without too much difficulty.

It would be desirable to construct and implement a container tray assembly that include a child resistant sleeve which is easy for adults to open while maintaining child resistance, because persons whom operate the container tray may have impaired hand strength and dexterity that may render opening other trays difficult.

SUMMARY OF THE INVENTION

In one embodiment of the present invention there is provided a container tray assembly configured to hold a substance. The assembly includes a container tray and sleeve.

The container tray includes a bottom terminating into a wall that extends to form upwardly extending end walls and upwardly extending side walls positioned between the end walls. The end walls and side walls form to surround an internal cavity, the container tray further has a flange positioned on the bottom and further positioned adjacent each end wall. The sleeve has a sleeve wall extending from a first opened end to a second opened end. The sleeve further has a sleeve length less than a container tray length defined on the long axis of the container tray. The sleeve further has a pair of notches separately positioned adjacent the first and second opened ends to separately correspond to the flanges on the bottom of the container tray, such that when the container tray is inserted into the sleeve the flanges engage the corresponding notches to define a secure configuration that prevents movement of the container tray relative the sleeve. The container tray being further configured to have a width less than an interior of the sleeve to define a gap along the side walls of the container tray length and wherein the sleeve is further made of a material configured to deform inwardly when an outside force squeezes the sleeve such that an inward deformation of the sleeve into the gap causes the flanges to move out of engagement with the corresponding notches to permit the container tray to slide into an unsecure configuration.

In another aspect of the invention, the container tray may also include a groove positioned on the bottom and further positioned adjacent each end wall. In yet another aspect, each groove and flange are positioned adjacent each other; and each groove may further be positioned closer to the upwardly extending end wall such that the flange is further positioned inwardly along a length of the container tray.

In another aspect of the invention, the container tray assembly may include a bead positioned on the side walls towards a middle region along the container tray length to permit squeezing of the sleeve only towards the first or second opened end.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein:

FIG. 10 illustrates a user squeezing the sleeve to push the container tray in accordance with an embodiment of the container tray assembly from FIG. 1;

DETAILED DESCRIPTION OF THE DRAWINGS

Figure 1:
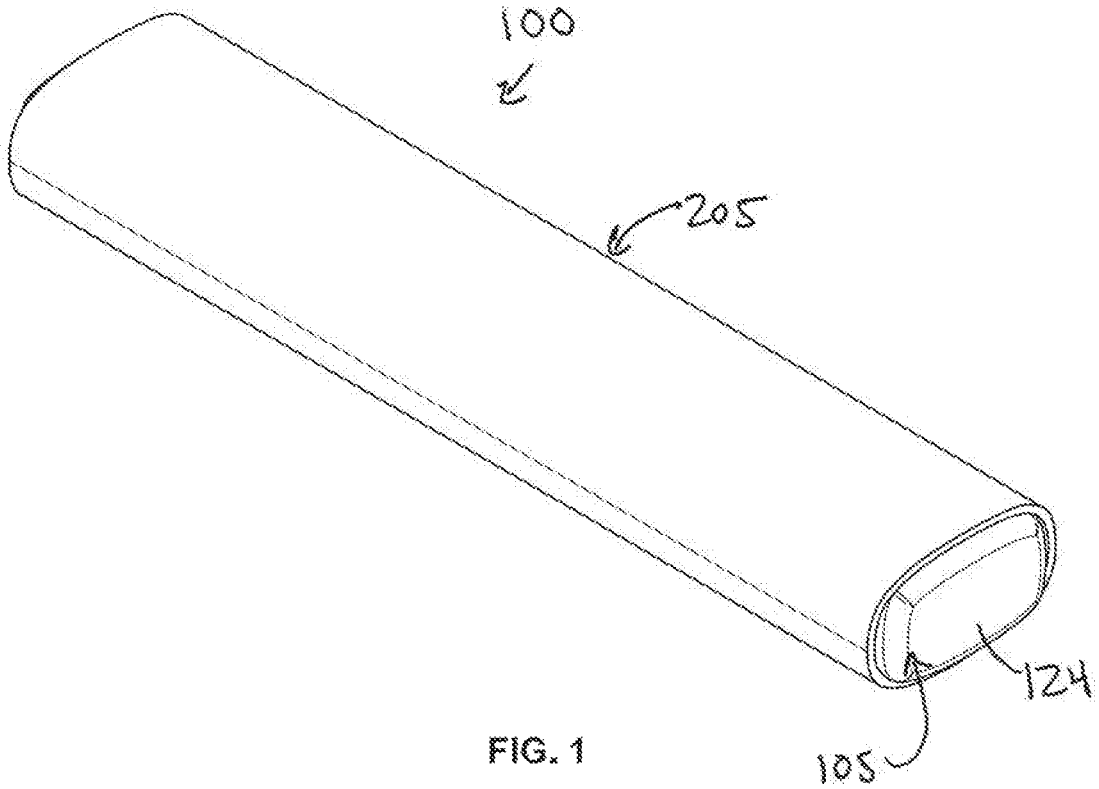
FIG. 1 is a perspective view of a container tray assembly in accordance with an embodiment of the present invention.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
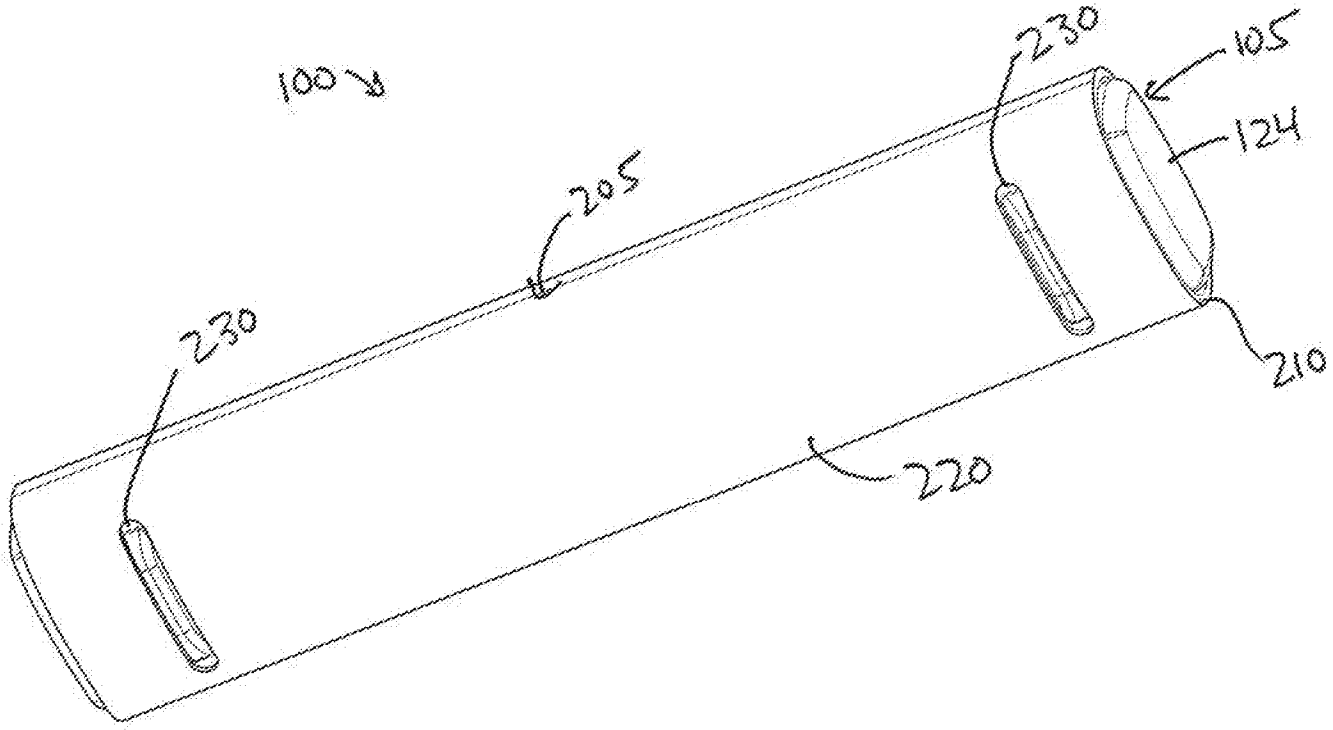
FIG. 2 is a perspective view from underneath the container tray assembly from FIG. 1.
Figure 3:
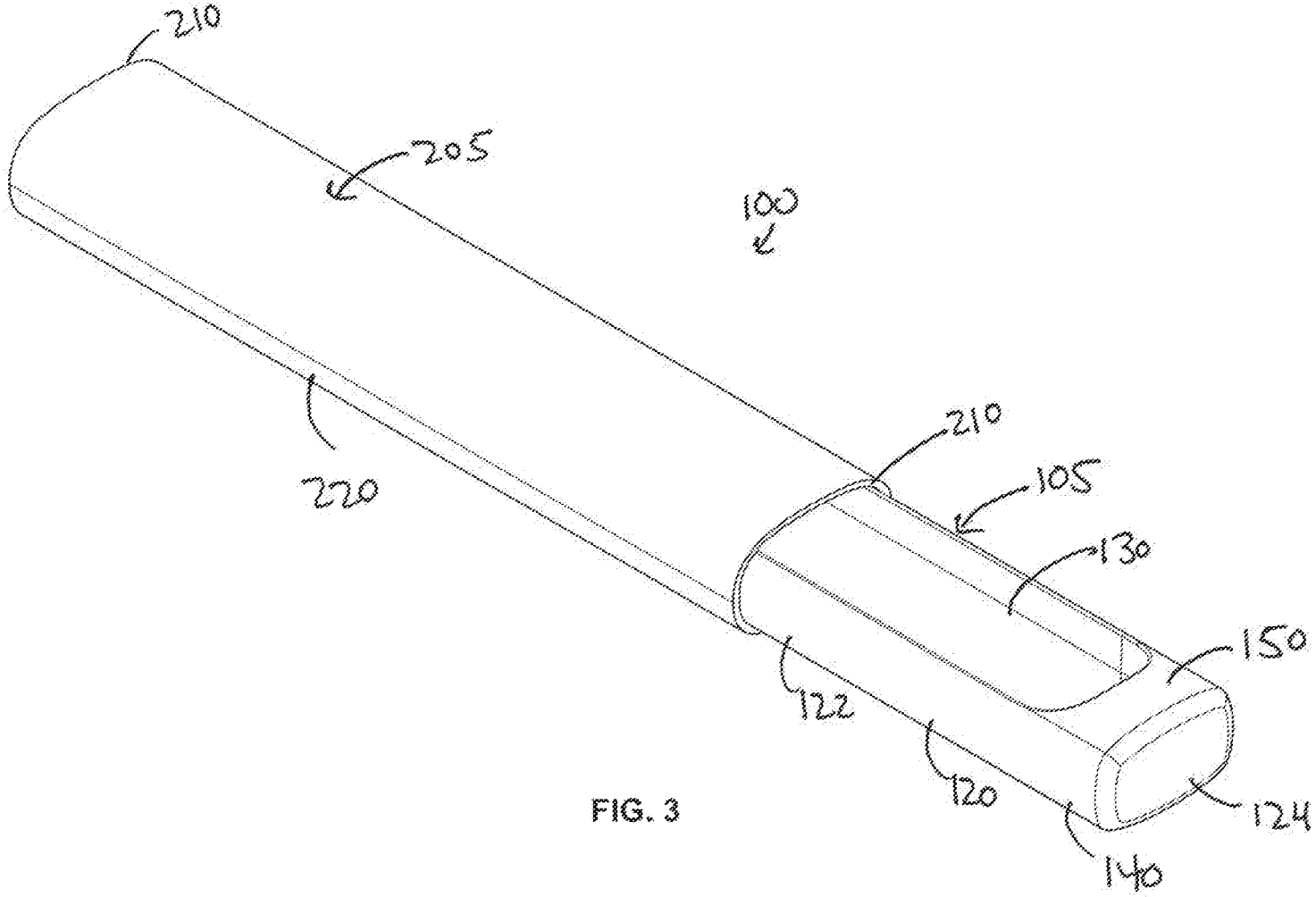
FIG. 3 is a perspective view of the container tray assembly from FIG. 1 illustrating the container tray being slid away from the sleeve.
Figure 4:
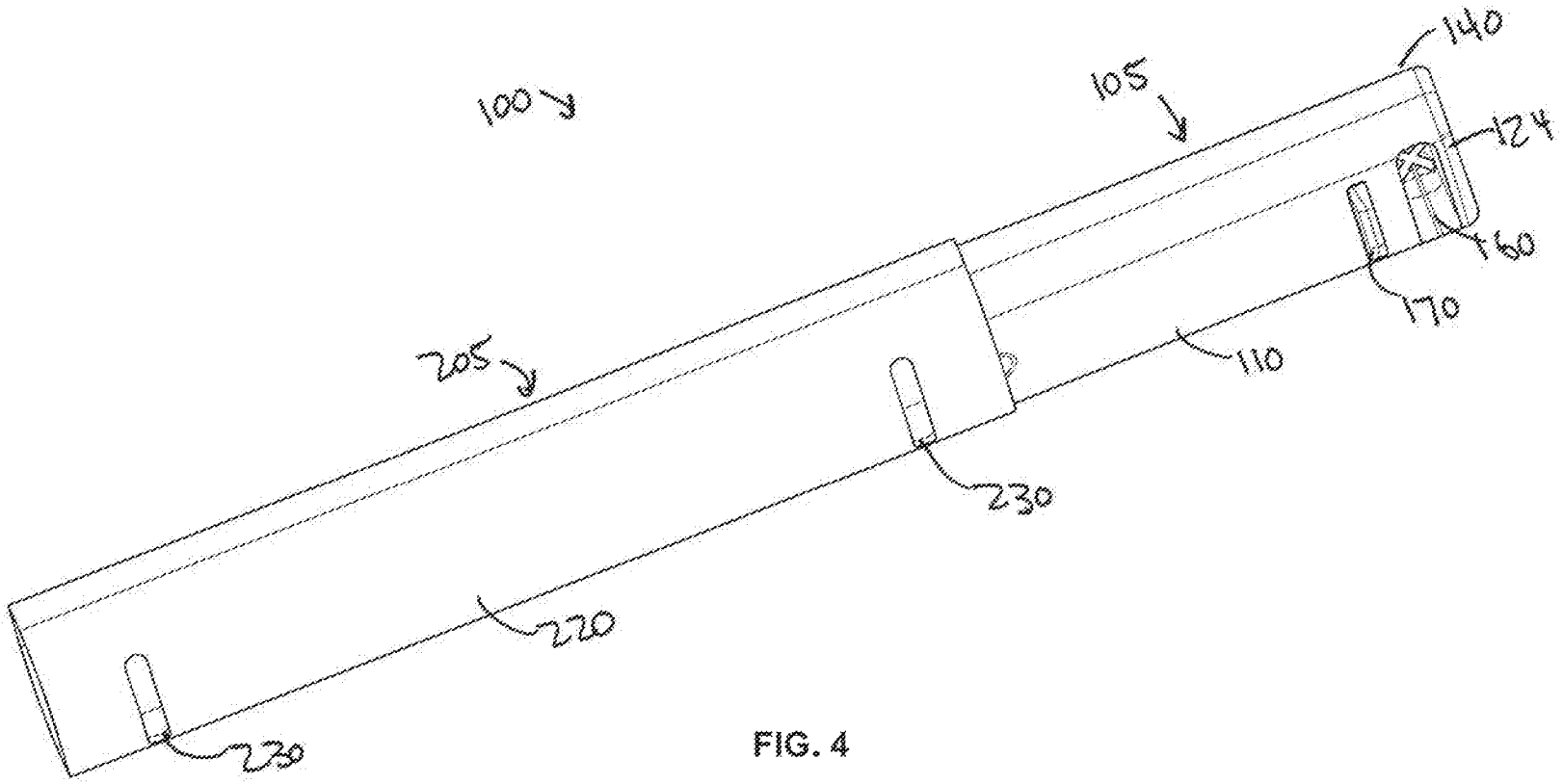
FIG. 4 is a perspective view from underneath the container tray assembly from FIG. 3.
Figure 5:
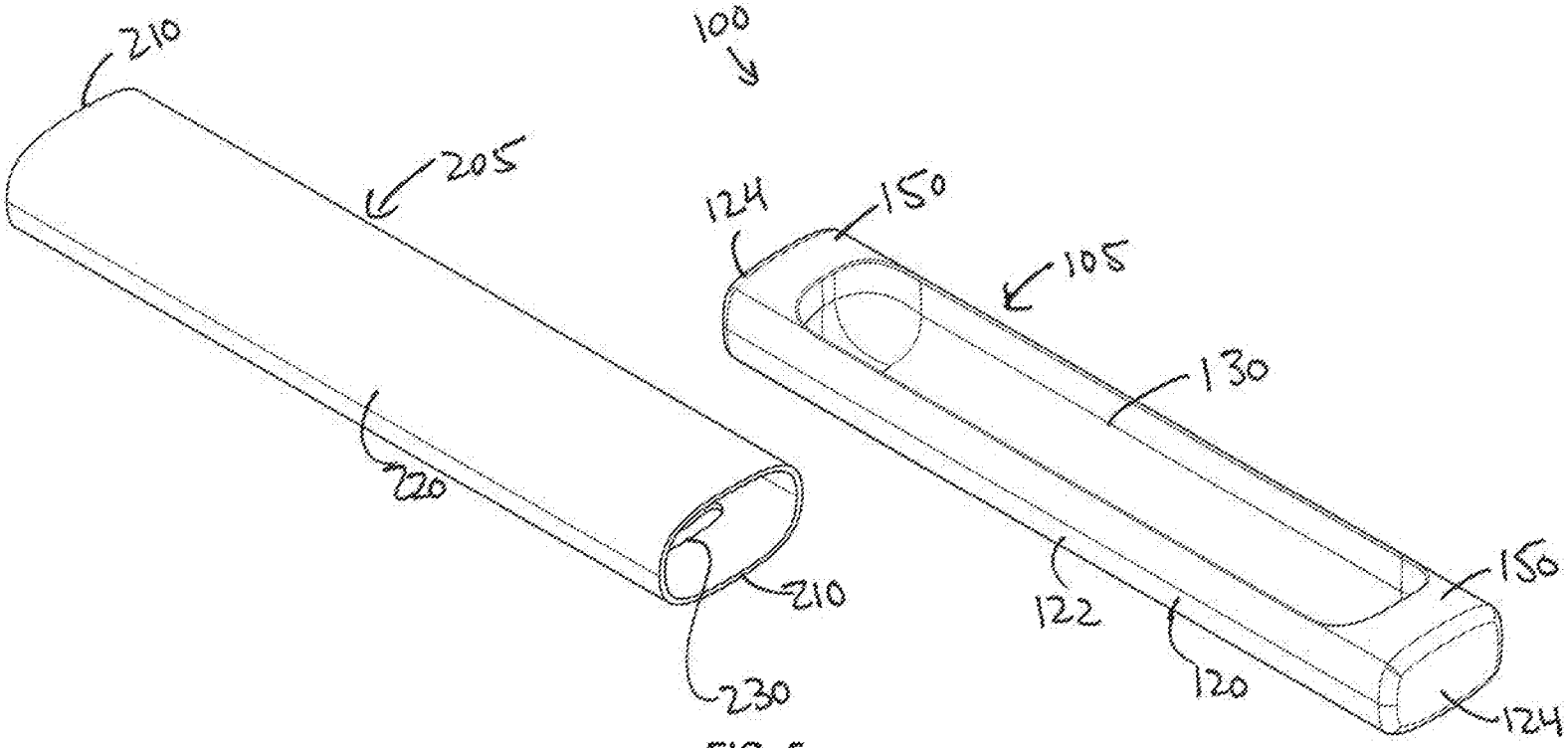
FIG. 5 is an exploded view of the container tray assembly from FIG. 1
Figure 6:
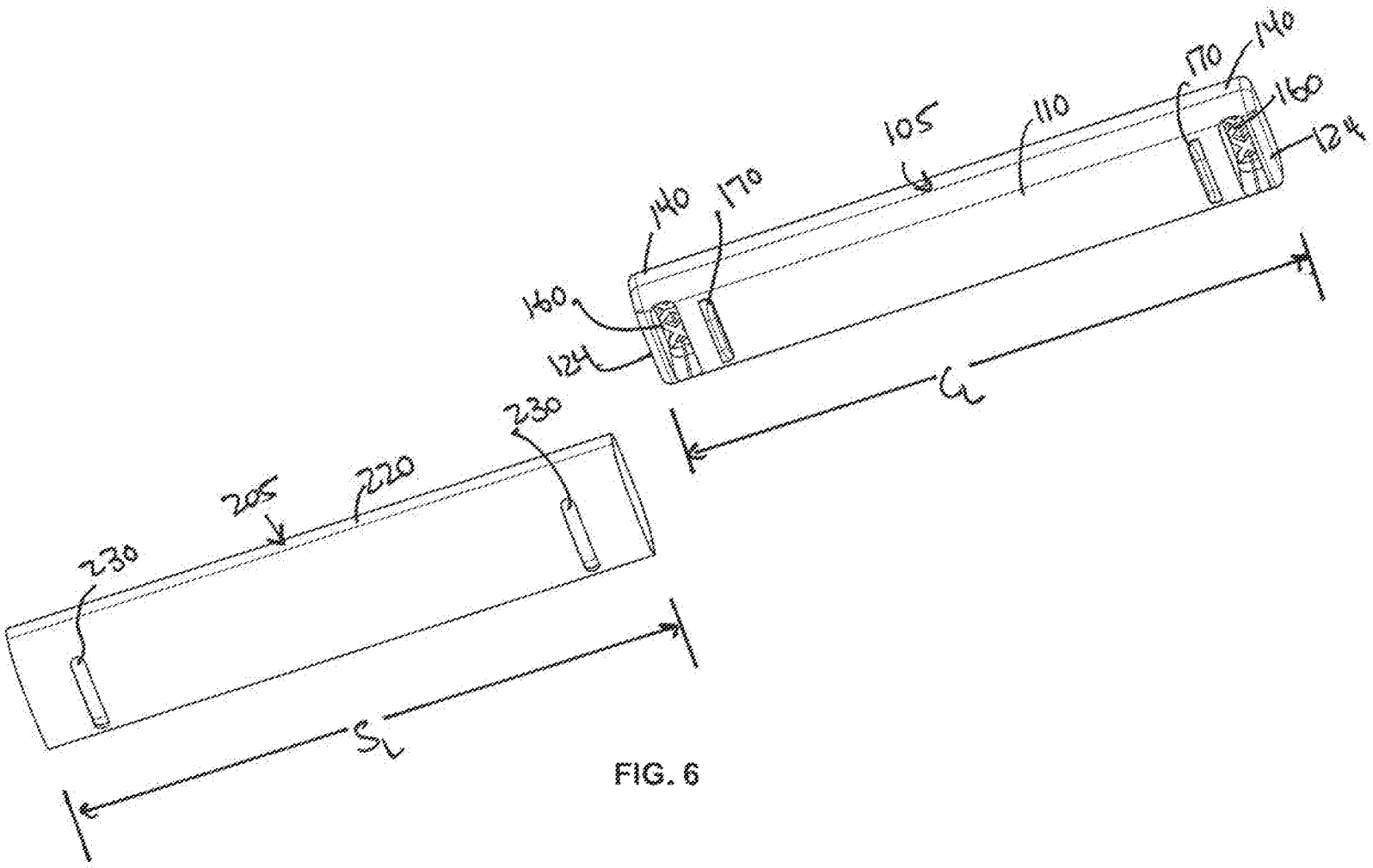
FIG. 6 is a exploded view from underneath the container tray assembly from FIG. 5.
Figures 7A, 7B, 7C, 7D:
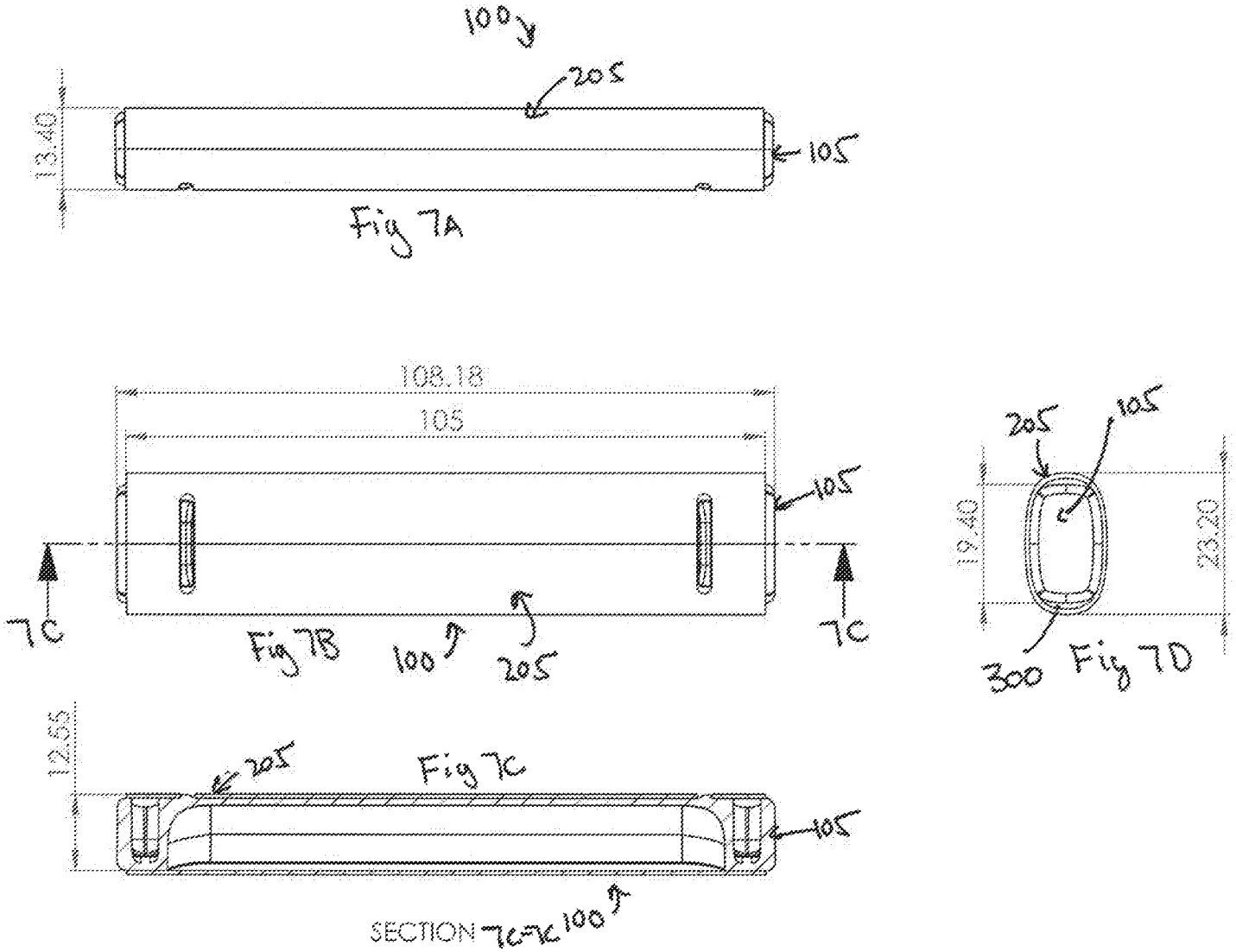
FIGS. 7A-7D are profile views of the container tray assembly from FIG. 1.
Figures 8A, 8B, 8C, 8D:
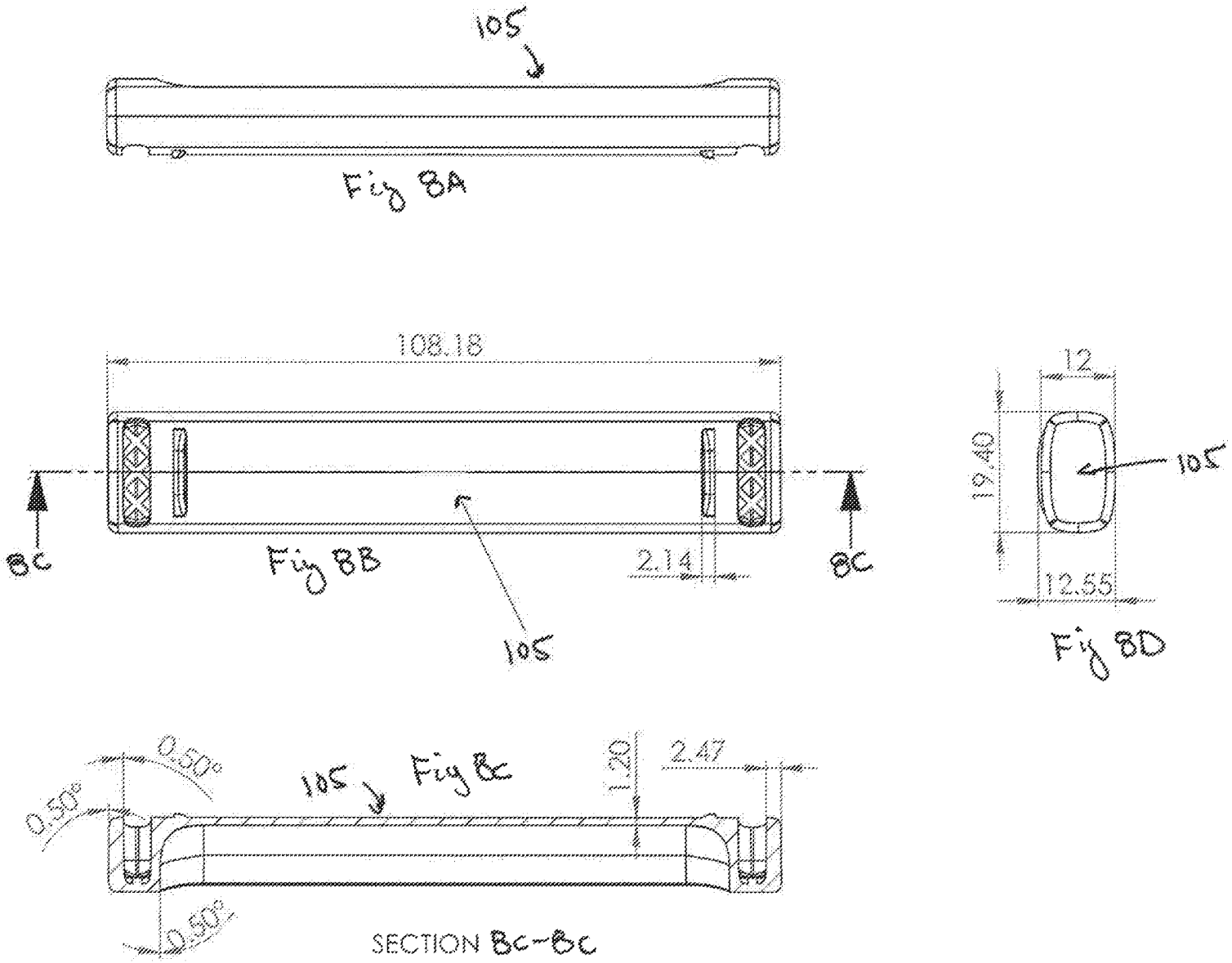
FIGS. 8A-8D are profile views of the container tray from the assembly from FIG. 1.
Figures 9A, 9B, 9C, 9D:
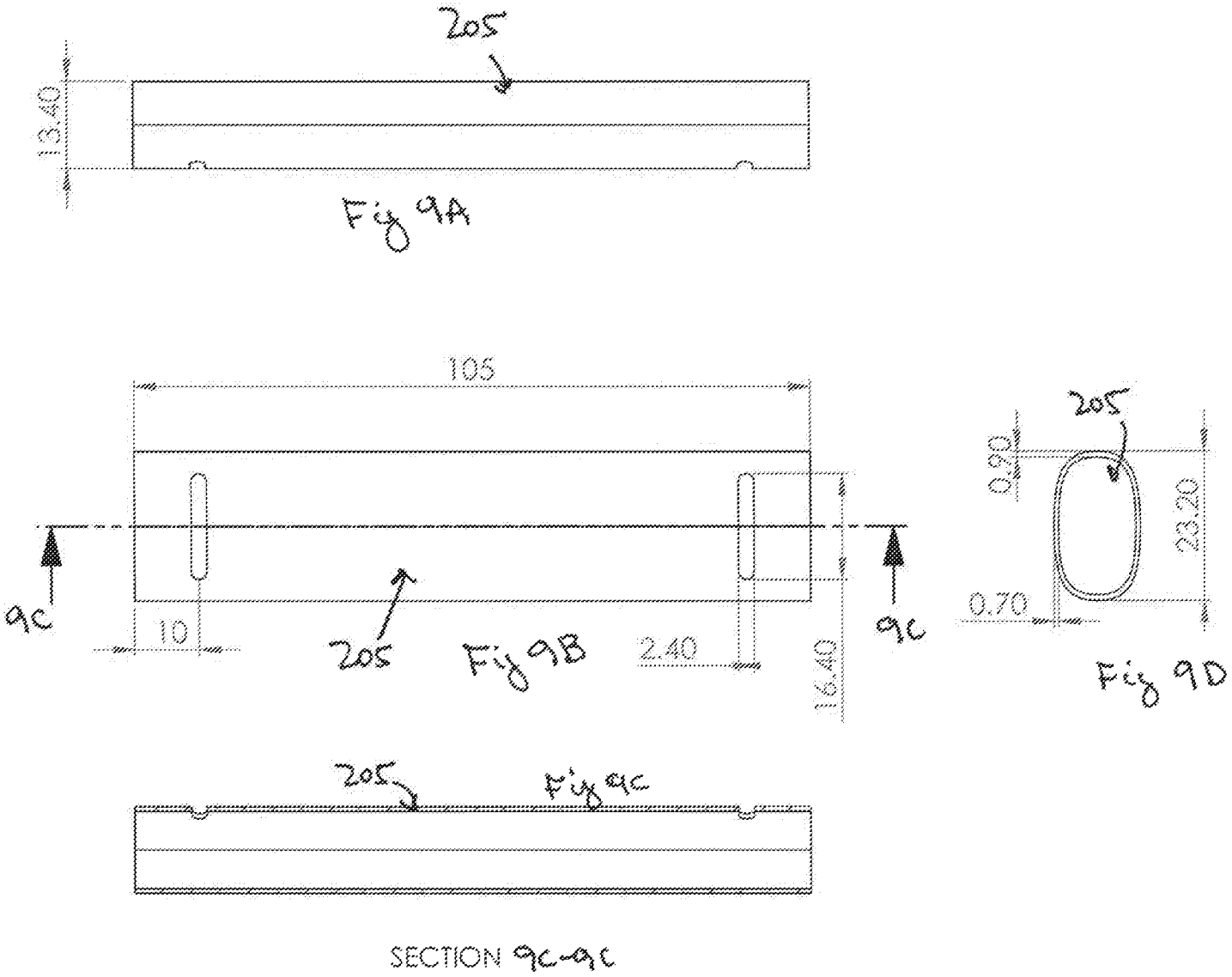
FIGS. 9A-9D are profile views of the sleeve from the assembly from FIG. 1.
Figure 9:
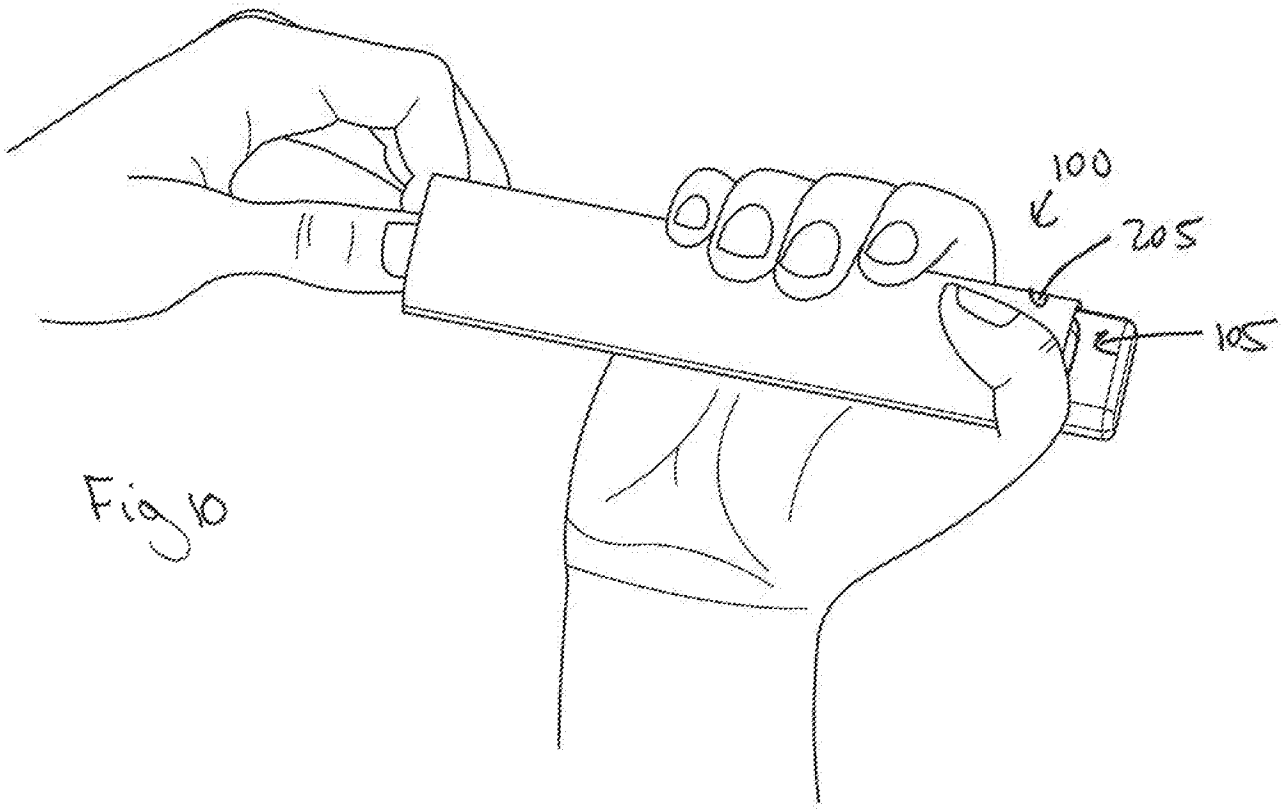
Figure 11:
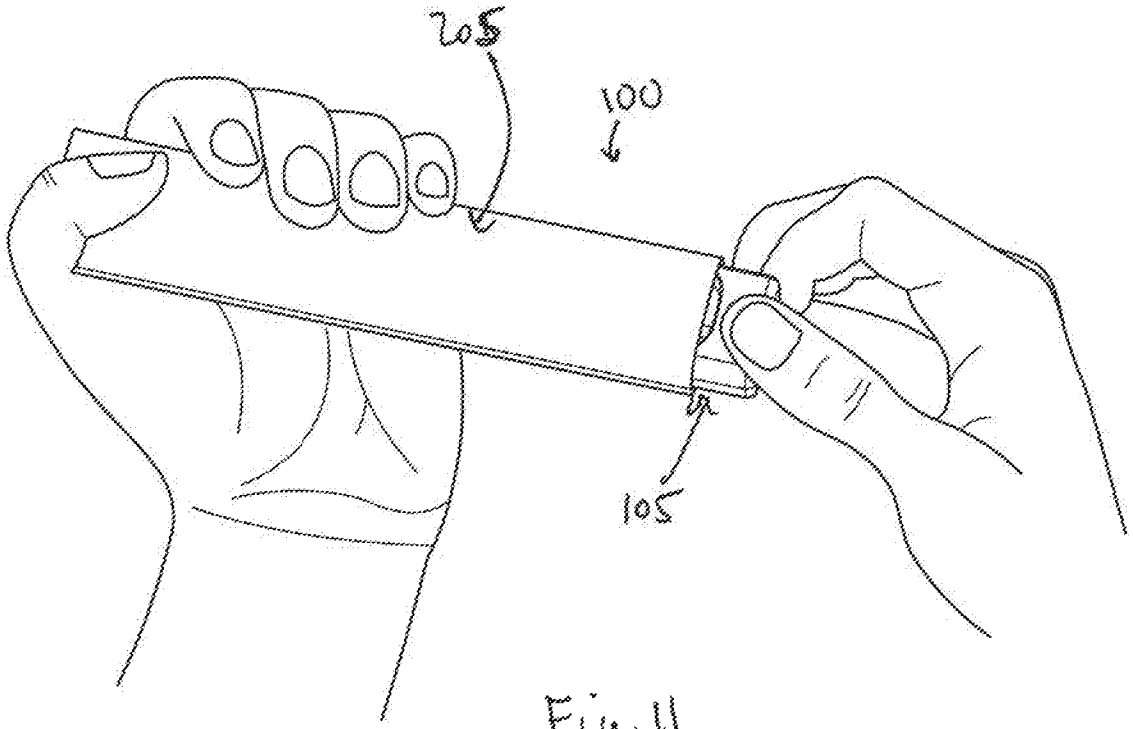
FIG. 11 illustrates a user pushing the container tray away from the sleeve in accordance with an embodiment of the container tray assembly from FIG. 1.
Figure 12:
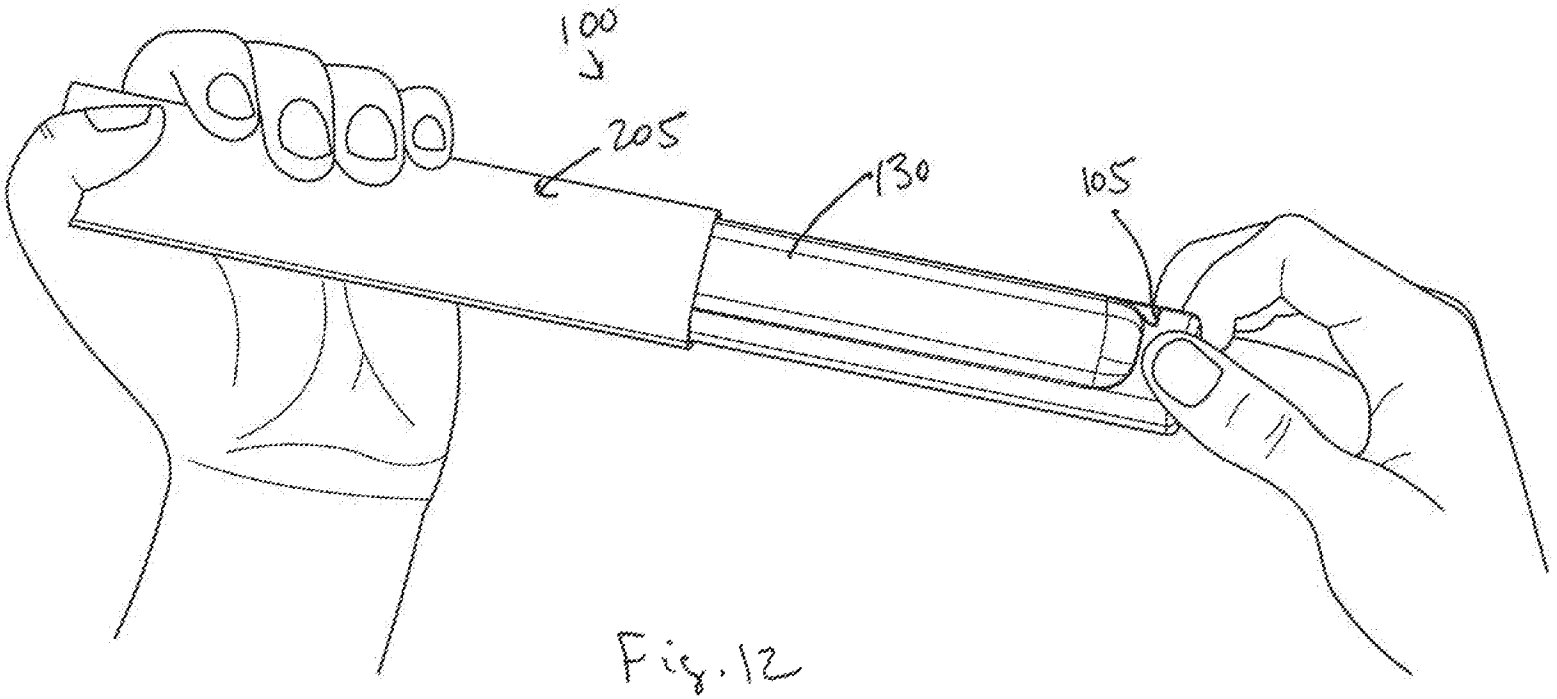
FIG. 12 illustrates a user further pulling the container tray away from the sleeve in accordance with an embodiment of the container tray assembly from FIG. 1.

Referring now to the figures, namely FIGS. 1 through 9D, there is shown a container tray assembly 100. The container tray assembly 100 may be used for storing and/or dispensing pharmaceutical or nutritional products, such as tablets, caplets, powders, or other forms of medication. The container tray assembly 100 is preferably a child-resistant container tray assembly 100. The container tray assembly 100 may be used for storing various types of material other than medication, such as a powder for drug reconstitution or nearly any other item that has a size and shape that is able to fit into the container assembly. The container tray assembly 100 preferably includes a container tray 105 and a sleeve 205.

As used herein, the term "container tray" refers to any type of storage receptacle for holding solid, liquid or gaseous material, including but not limited to bottles, vials, tubes, vessels, or other receptacles, having at least one opening for depositing or dispensing contents.

The container tray 105 includes a bottom 110 terminating to a wall 120 that extends upwardly to form upwardly extending side walls 122 and upwardly extending end walls 124, which then surround an internal cavity or containment area 130 therein. The opposing ends 140 of the container tray 105 terminate into top end ridges 150. As further shown in the figures, the top end ridges 150 prevent the user from gaining access into the internal cavity when the sleeve 205 is in place, meaning once the sleeve 205 is properly in place the internal cavity is completely surrounding by the sleeve.

Each of the opposing ends 140 of the container tray 105 on the bottom 110 thereof includes a groove 160 and a flange 170. Each groove and flange pair are adjacent each other. In one embodiment the groove 160 are closer to the upwardly extending end walls 124 with the flanges 170 positioned inwardly along a length $C_L$ of the container tray 105.

The present invention further includes a sleeve 205 that has a length $S_L$ that is slightly shorter in length than the length $C_L$ of the container tray 105, such that when in place the end walls 124 of the container tray 105 extend out from the sleeve ends 210. Percent wise the length of the container tray may only be about 2-3% longer than the sleeve, leaving about one to two millimeters extending on either side.

The sleeve 205 is opened at both side ends 210 and includes a sleeve wall 220 that extends and surrounds the two side ends 210. The sleeve wall 220 further includes a pair of notches 230 separately positioned one the two side ends 210, such that each notch 230 corresponds to one of the flanges 170. When the sleeve 205 is positioned over the container tray in a secure configuration (when movement of the sleeve 205 is impeded) the flanges 170 sit into its corresponding notch 230.

The sleeve 205 is further configured in an oval configuration to align with the outer profile configuration of the container tray. However, the container tray is slightly less wide than the interior of the oval sleeve, leaving a gap 300 along the long axis on either side of the container tray. The gap allows the sleeve to be squeezed by the user towards the middle of the sleeve to deform the sleeve ends into the gap 300, which then expands the sleeve along the short axis permitting the container tray to slide within the sleeve. During the manual deformation of the sleeve, the notches 230 are moved or deformed away from the flanges 170 such that the flanges 170 no longer sit in the corresponding notch 230 permitting the container tray to slide (unsecure or opened configuration). When the sleeve is manually squeezed the container tray may slide completely out or if the user stops squeezing the sleeve will return to a resting configuration which may act to impede further movement. In the secure configuration, the container tray ends 140 cannot be pushed through the sleeve unless the user simultaneously squeezes one end of the sleeve and pushes the container tray through from the opposite side.

Figure 13:
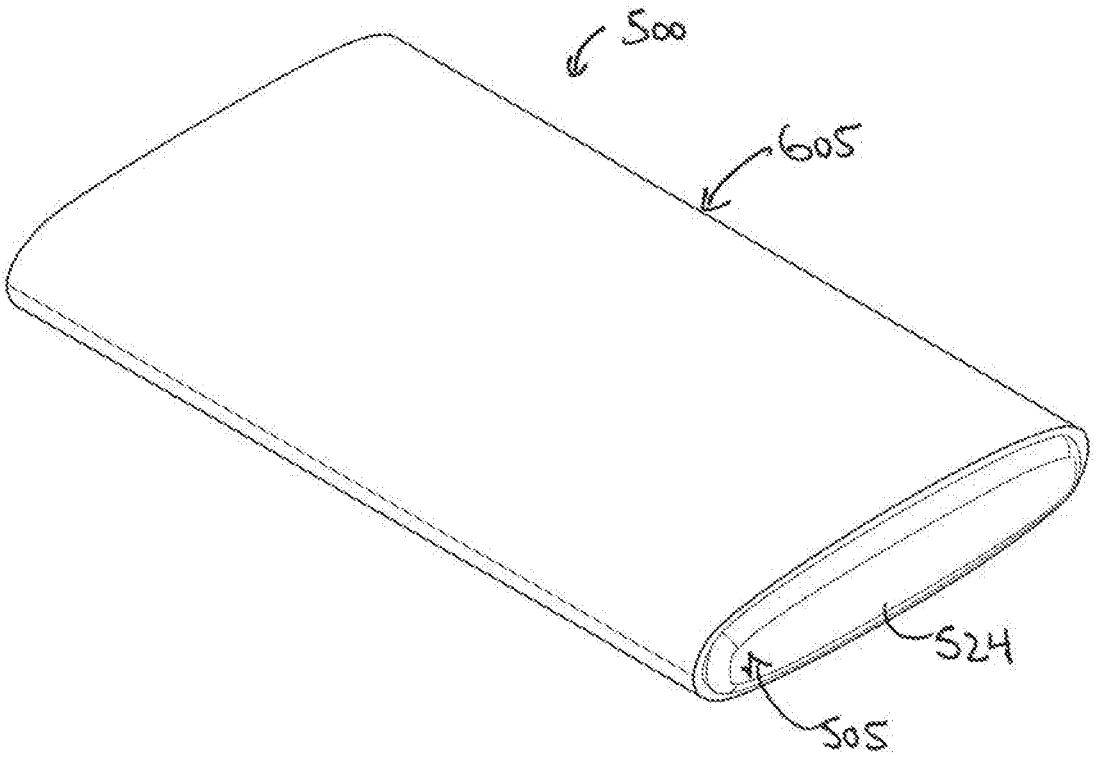
FIG. 13 is a perspective view of a container tray assembly in accordance with an embodiment of the present invention.
Figure 14:
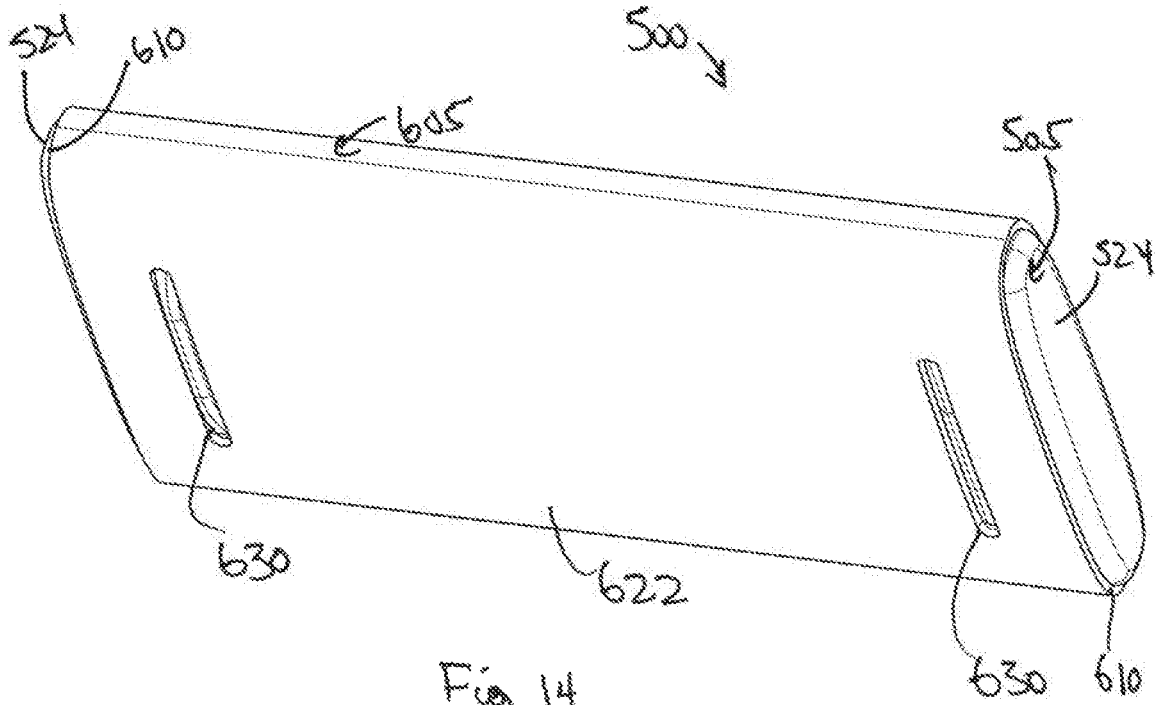
FIG. 14 is a perspective view from underneath the container tray assembly from FIG. 13.
Figure 15:
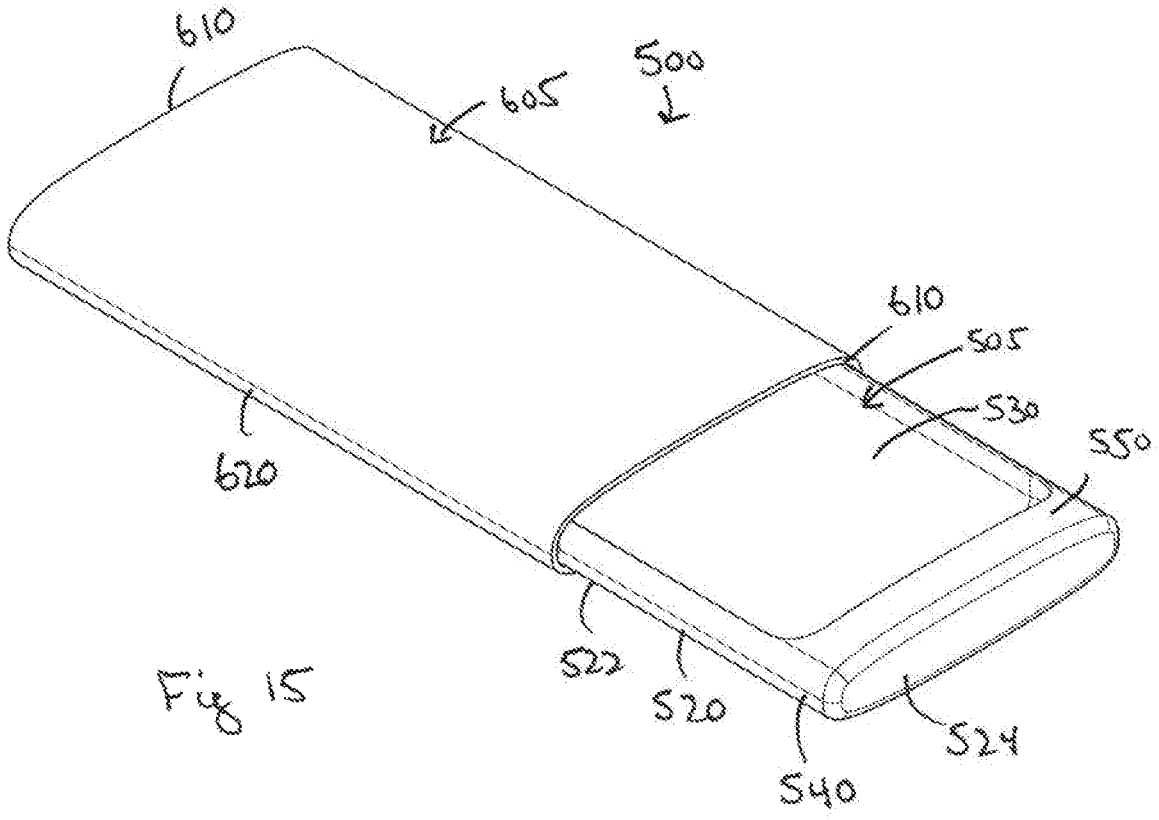
FIG. 15 is a perspective view of the container tray assembly from FIG. 13 illustrating the container tray being slid away from the sleeve.
Figure 16:
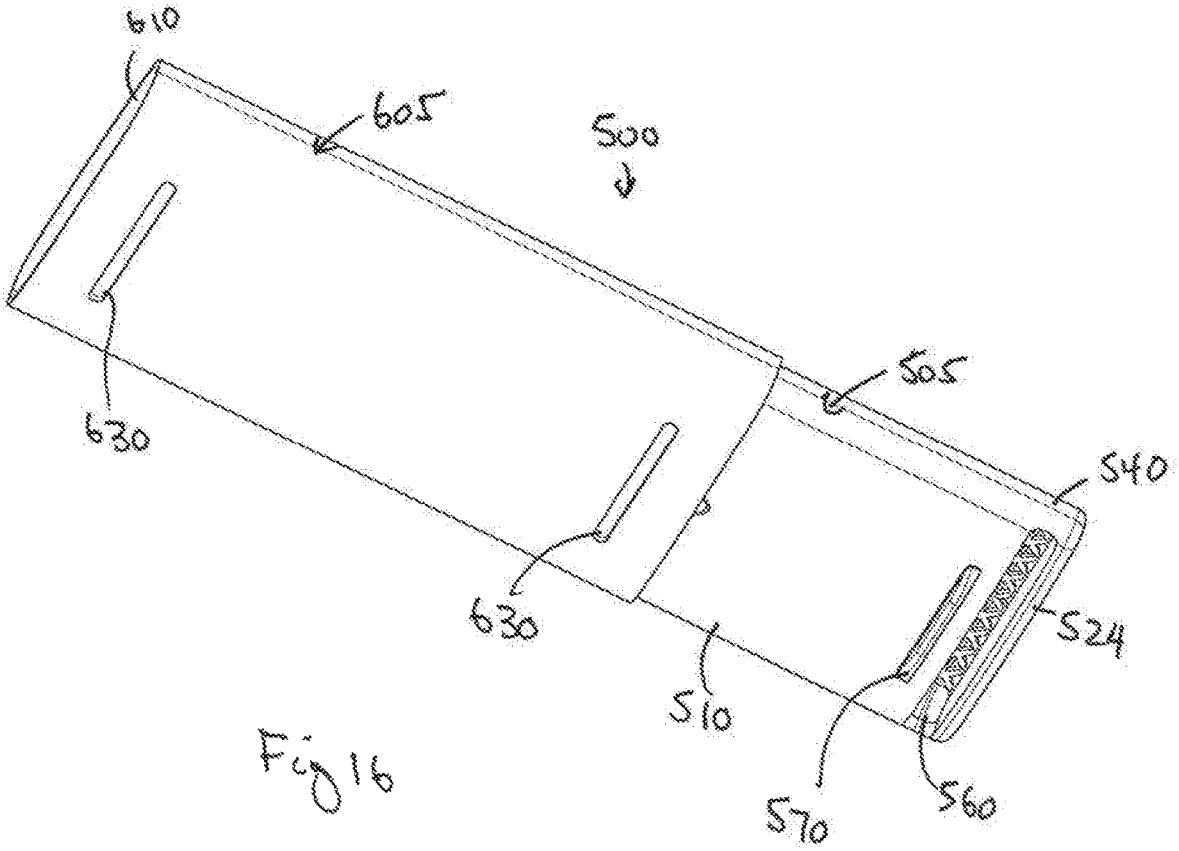
FIG. 16 is a perspective view from underneath the container tray assembly from FIG. 15.
Figure 17:
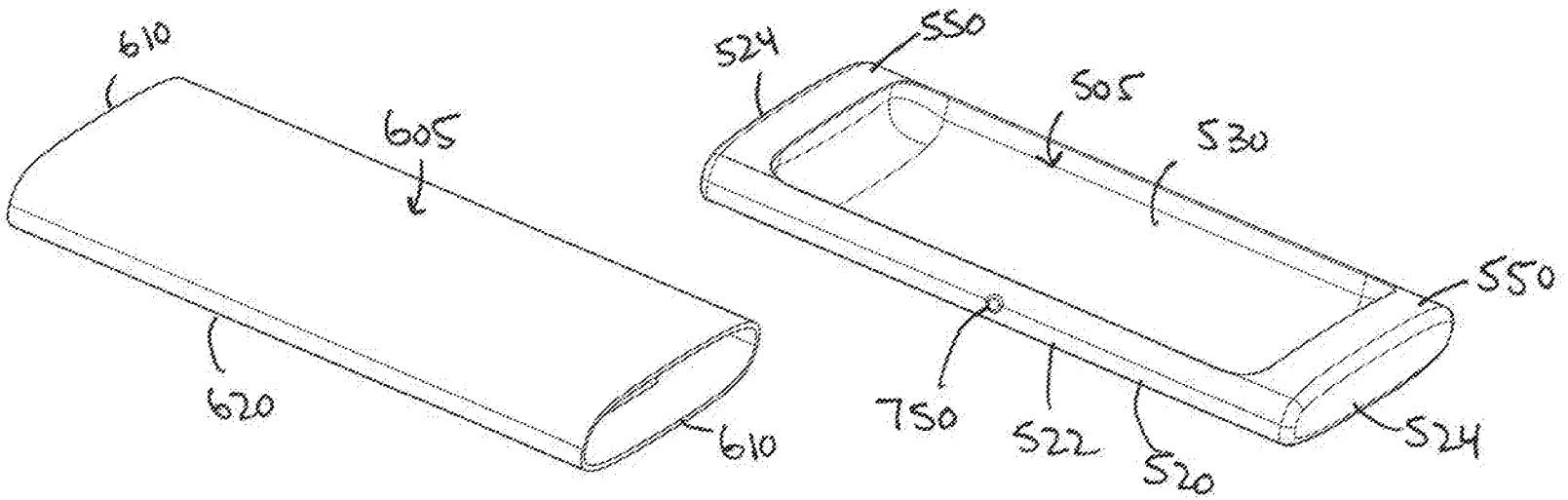
FIG. 17 is an exploded view of the container tray assembly from FIG. 13
Figure 18:
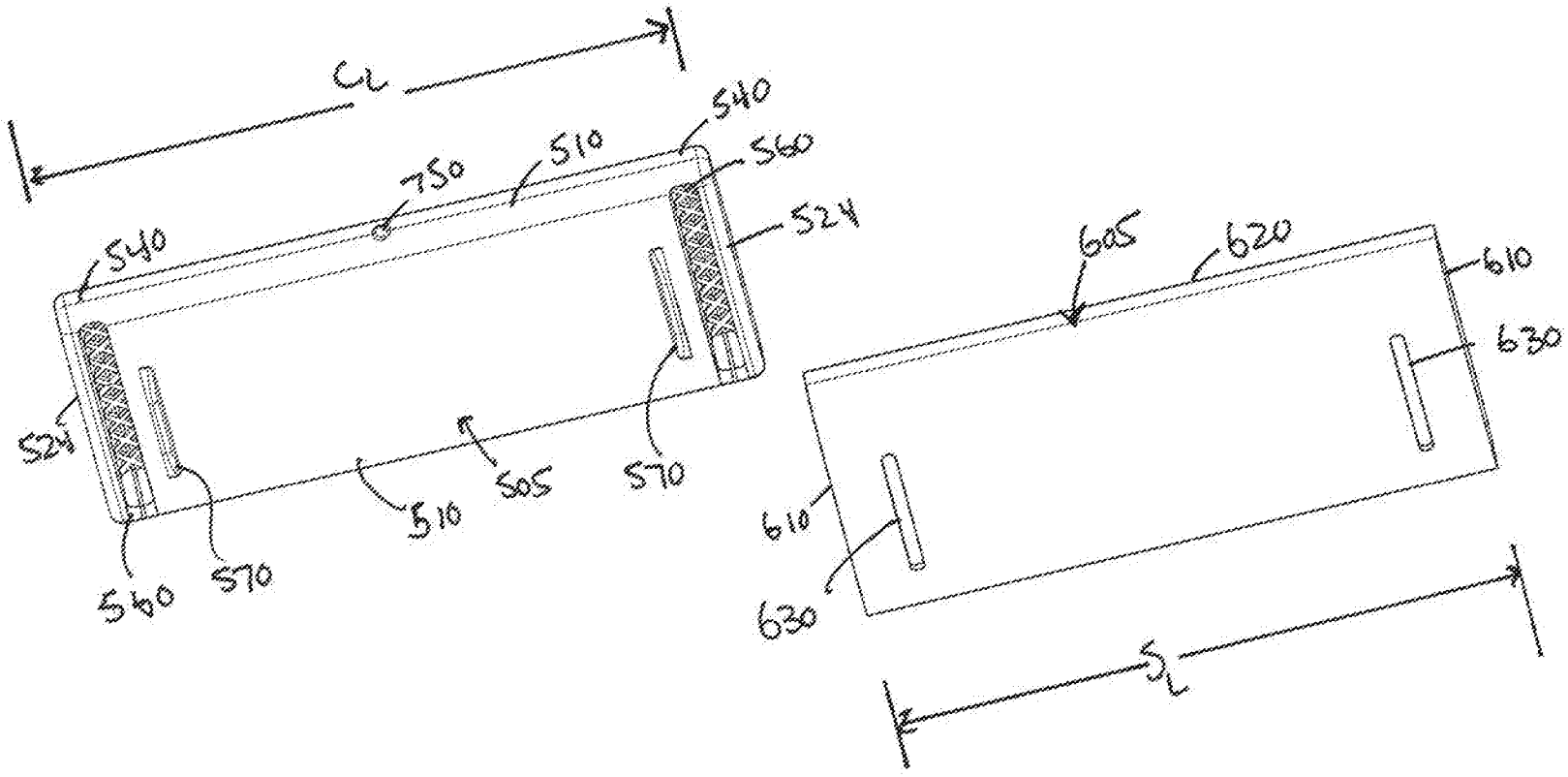
FIG. 18 is a exploded view from underneath the container tray assembly from FIG. 17.
Figures 19A, 19B, 19C, 19D:
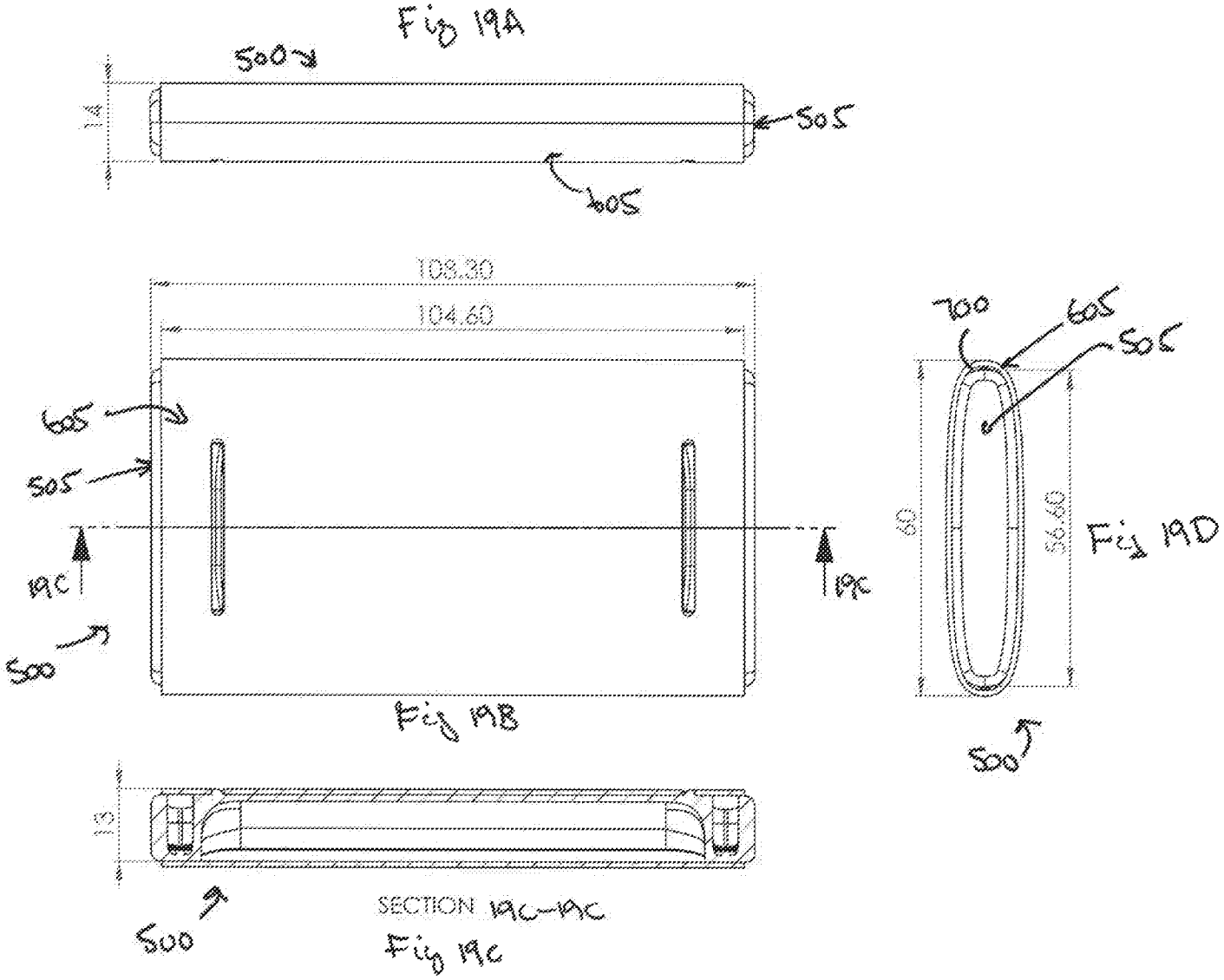
FIGS. 19A-19D are profile views of the container tray assembly from FIG. 13.
Figures 20A, 20B, 20C, 20D:
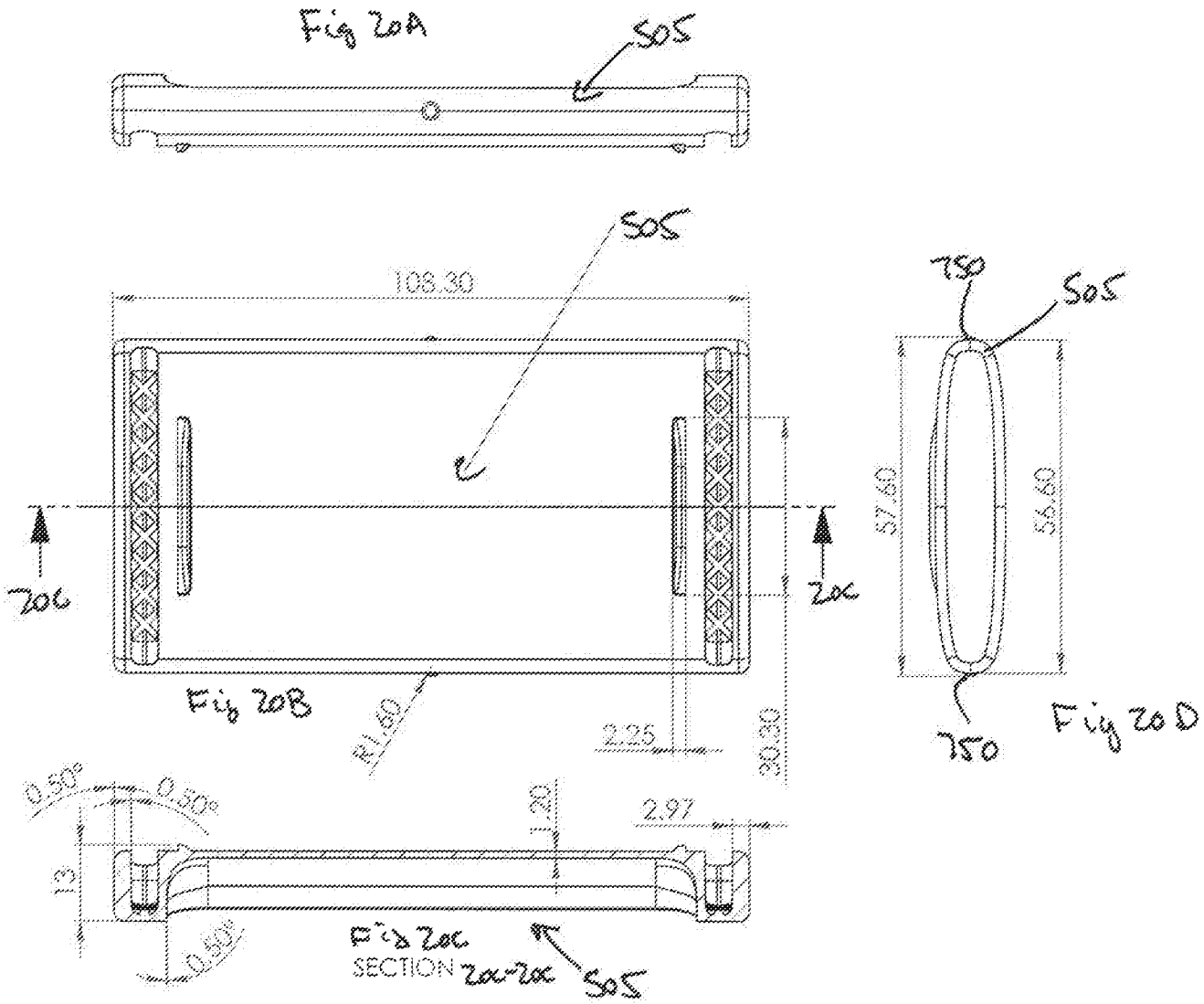
FIGS. 20A-20D are profile views of the container tray from the assembly from FIG. 13.
Figures 21A, 21B, 21C, 21D:
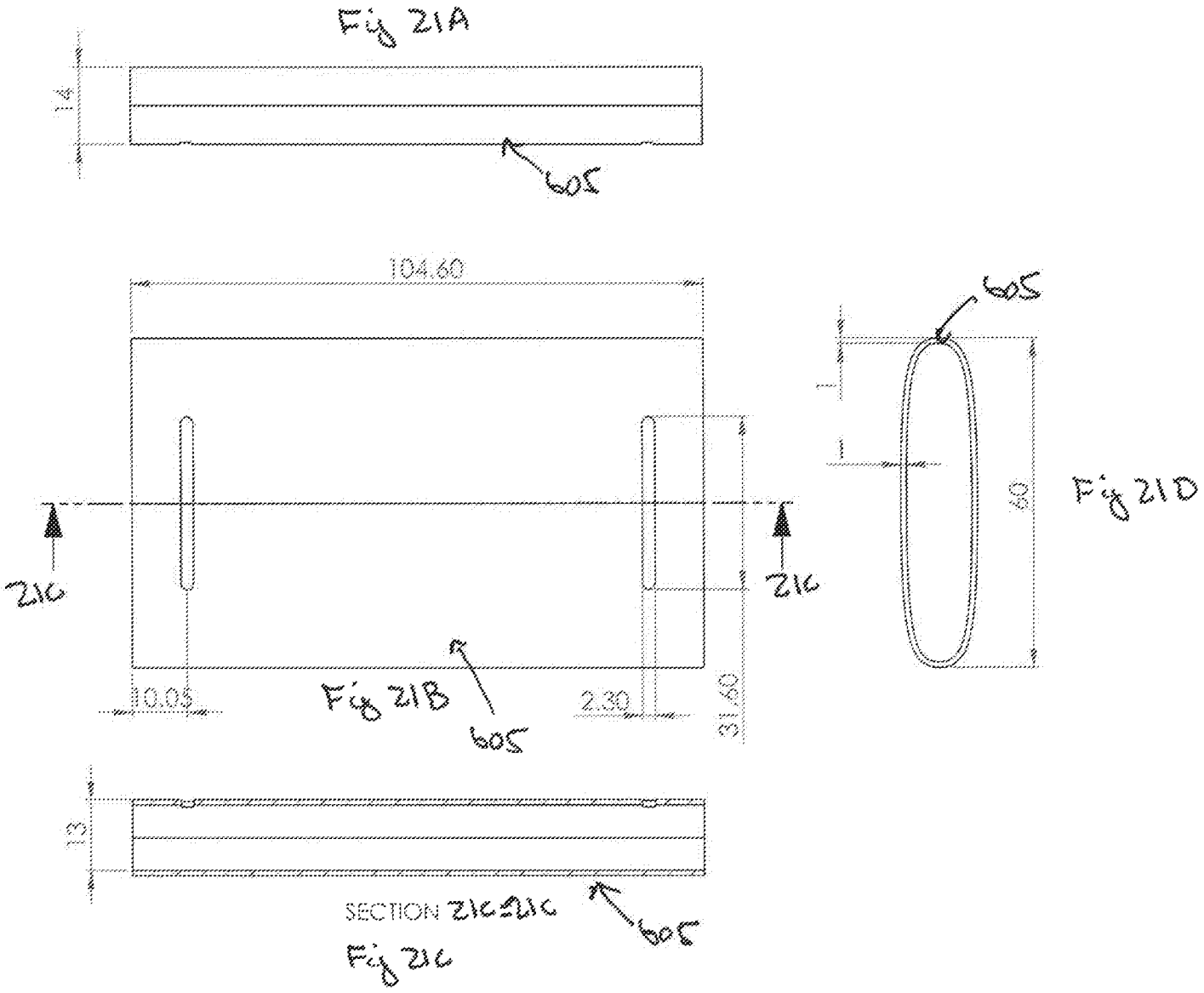
FIGS. 21A-21D are profile views of the sleeve from the assembly from FIG. 13.
Figure 22:
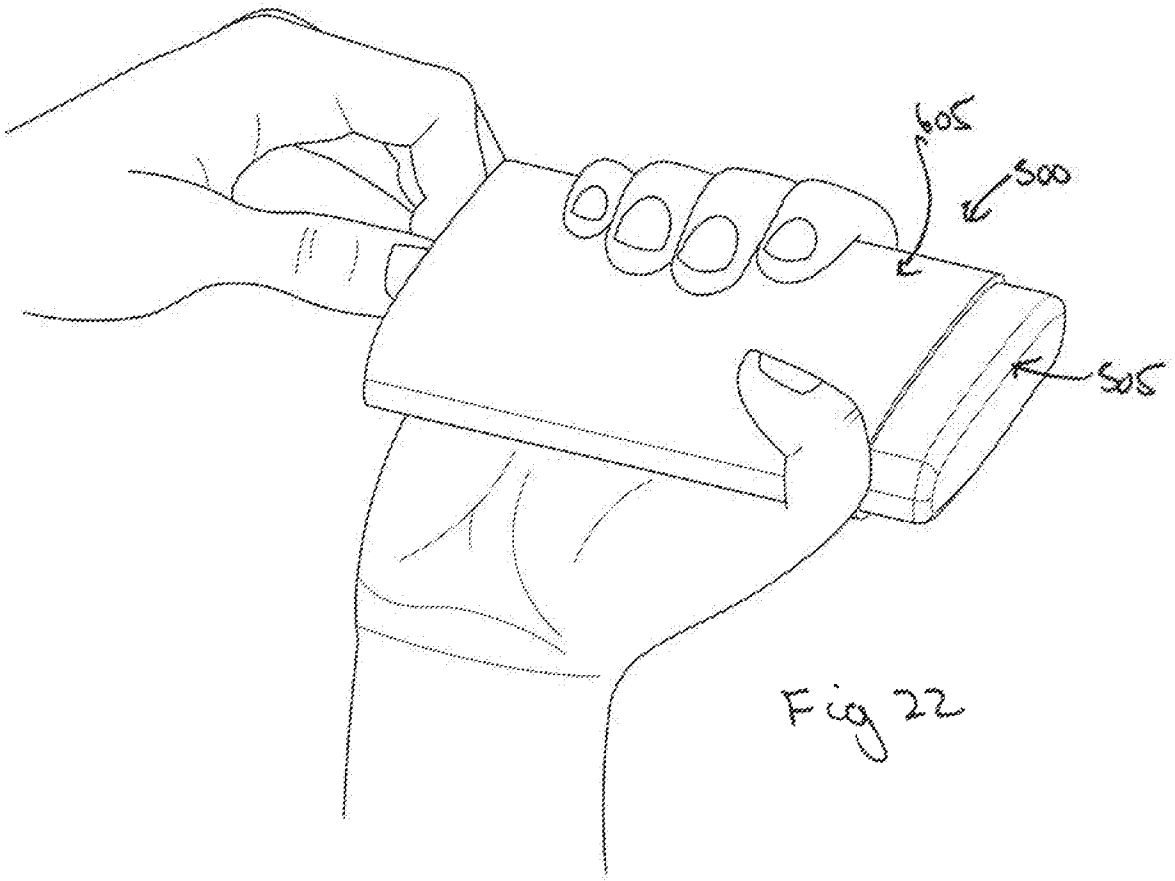
FIG. 22 illustrates a user squeezing the sleeve to push the container tray in accordance with the container tray assembly from FIG. 13.
Figure 23:
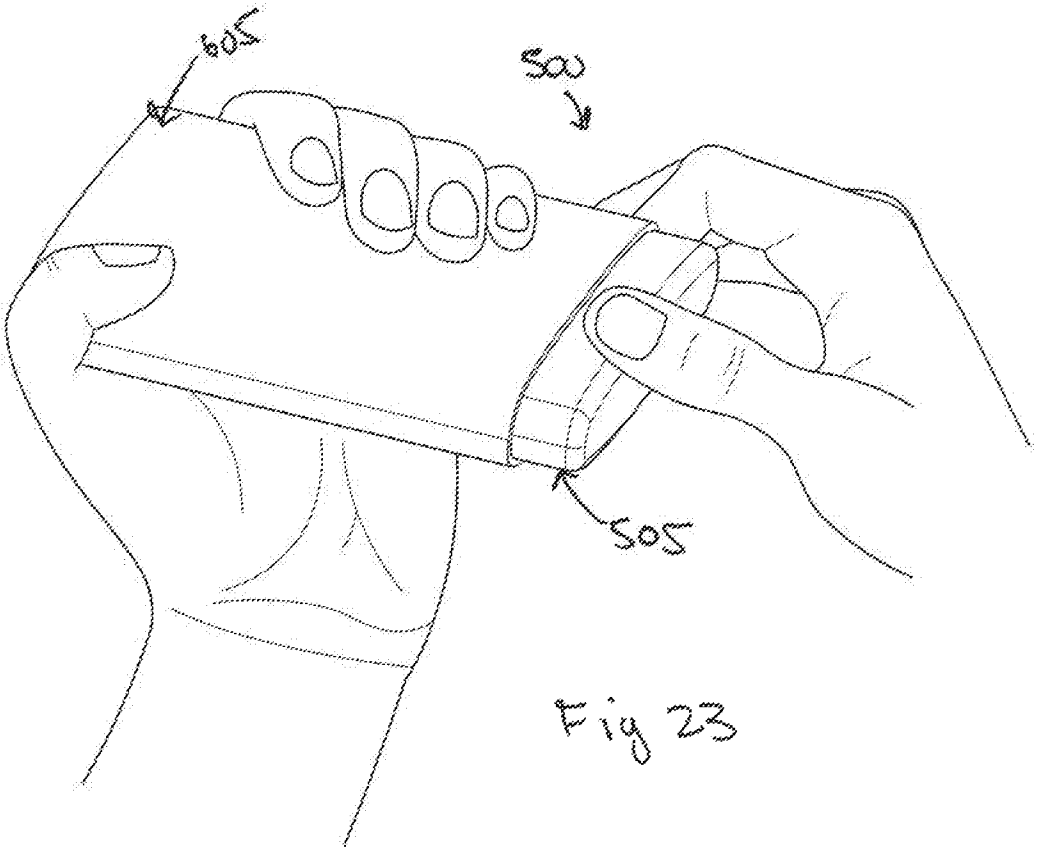
FIG. 23 illustrates a user pushing the container tray away from the sleeve in accordance with an embodiment of the container tray assembly from FIG. 13.
Figure 24:
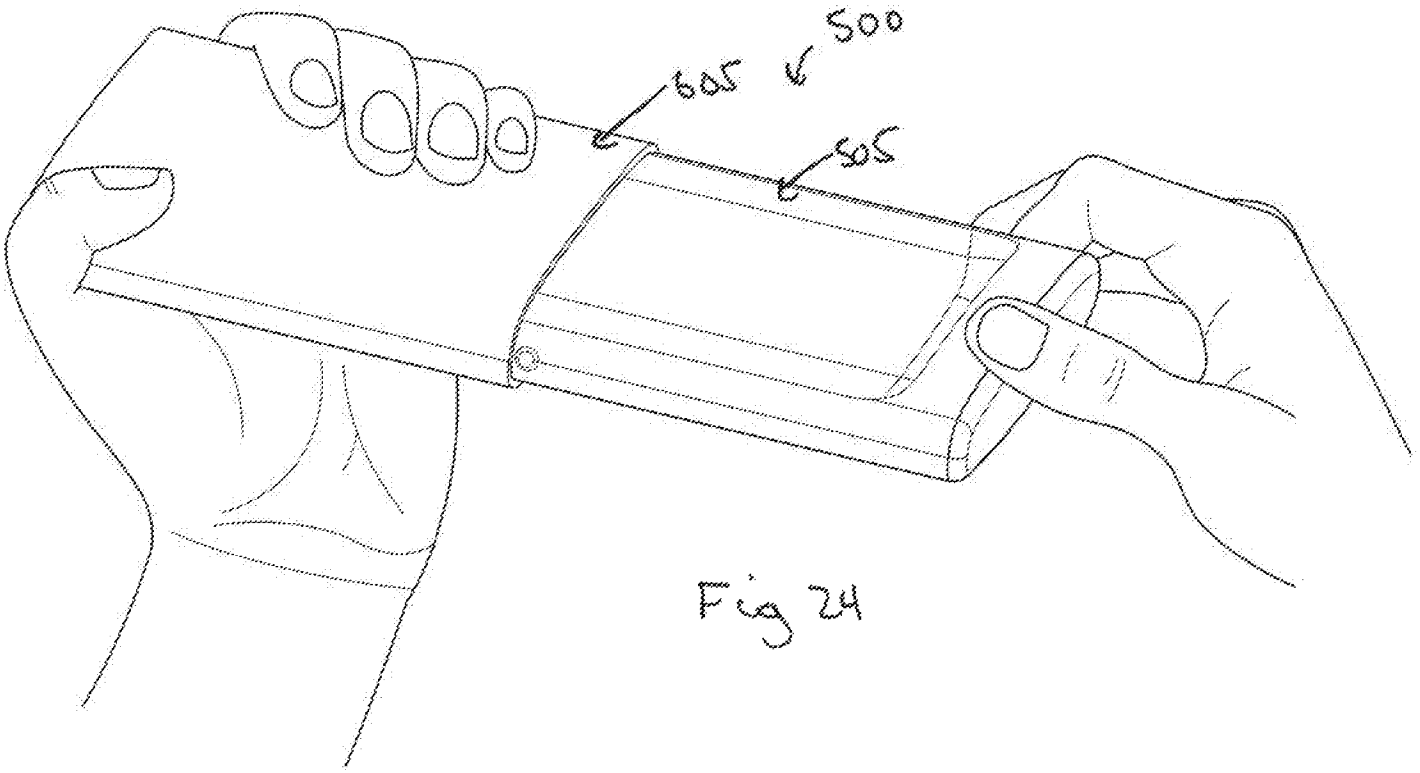
FIG. 24 illustrates a user further pulling the container tray away from the sleeve in accordance with an embodiment of the container tray assembly from FIG. 13.
Figure 25:
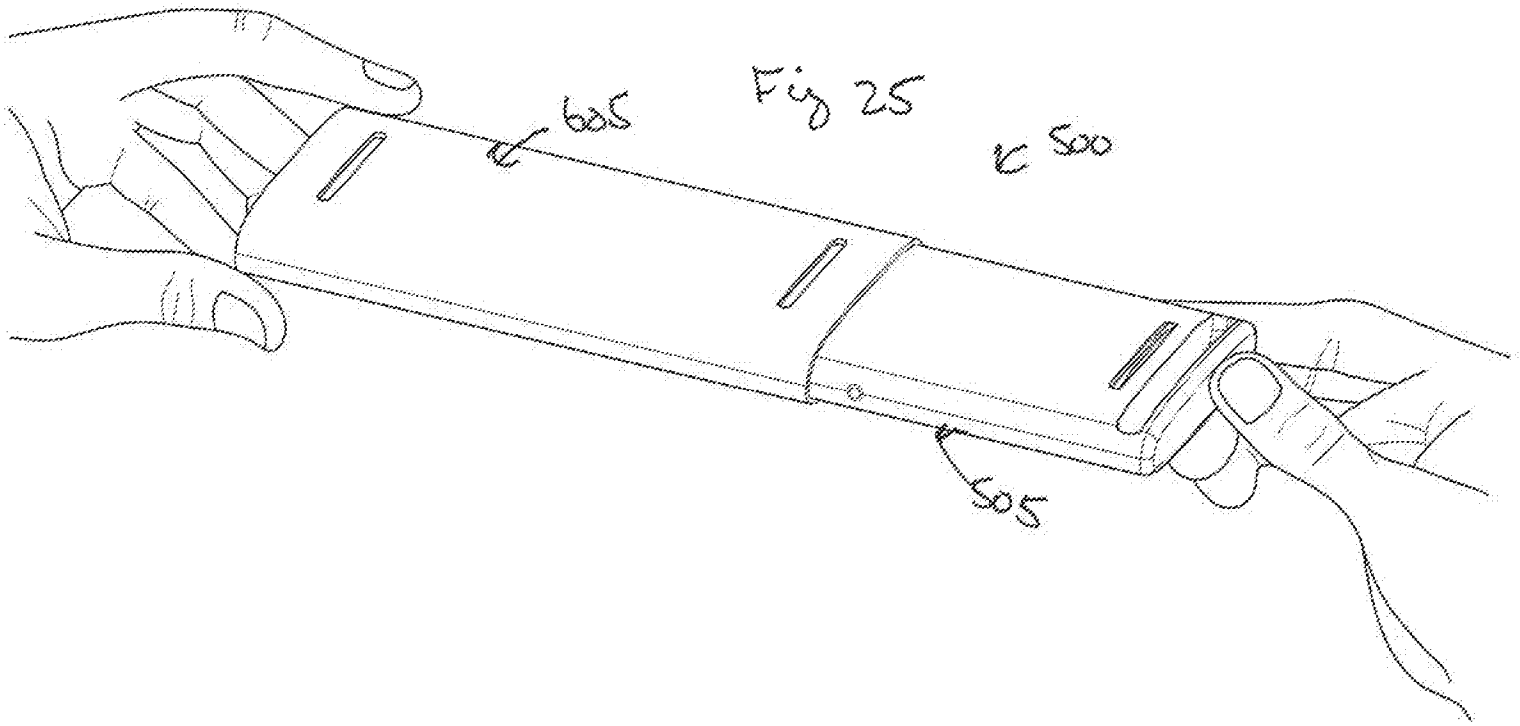
FIG. 25 illustrates from underneath the container tray assembly from FIG. 24.

Similar in operation and configuration to the first embodiment and referring now to FIGS. 13-27. a second embodiment is provided that is larger in shape than the first embodiment. However, it employs very similar aspects and concepts, in that it includes a container tray assembly that has a container tray 505 with a sleeve 605, which when placed over the container tray 505 requires further manipulation of the sleeve 605 to gain access to an interior cavity 530 defined by the container tray 500.

The container tray 505 includes a bottom 510 terminating to a wall 520 that extends upwardly to form upwardly extending side walls 522 and upwardly extending end walls 524, which then surround an internal cavity or containment area 530 therein. The opposing ends 540 of the container tray 505 terminate into top end ridges 550. As further shown in the figures, the top end ridges 550 prevent the user from gaining access into the internal cavity when the sleeve 505 is in place, meaning once the sleeve 505 is properly in place the internal cavity is completely surrounding by the sleeve.

Each of the opposing ends 540 of the container tray 505 on the bottom 510 thereof includes a groove 560 and a flange 570. Each groove and flange pair are adjacent each other. In one embodiment the groove 560 are closer to the upwardly extending end walls 524 with the flanges 570 positioned inwardly along a length $C_L$ of the container tray 505.

The present invention further includes a sleeve 605 that has a length $S_L$ that is slightly shorter in length than the length $C_L$ of the container tray 505, such that when in place the end walls 524 of the container tray 505 extend out from the sleeve ends 610. Percent wise the length of the container tray may only be about 2-3% longer than the sleeve, leaving about one to two millimeters extending on either side.

The sleeve 605 is opened at both side ends 610 and includes a sleeve wall 620 that extends and surrounds the two side ends 610. The sleeve wall 620 further includes a pair of notches 630 separately positioned one the two side ends 610, such that each notch 630 corresponds to one of the flanges 670. When the sleeve 605 is positioned over the container tray in a secure configuration (when movement of the sleeve 605 is impeded) the flanges 570 sit into its corresponding notch 630.

The sleeve 605 is further configured in an oval configuration to align with the outer profile configuration of the container tray. However, the container tray is slightly less wide than the interior of the oval sleeve, leaving a gap 700 along the long axis on either side of the container tray. The gap allows the sleeve to be squeezed by the user towards one end of the sleeve to deform the sleeve end into the gap 700, which then expands the sleeve along the short axis permitting the container tray to slide within the sleeve. During the manual deformation of the sleeve, the notches 630 are moved or deformed away from the flanges 570 such that the flanges 570 no longer sit in or engage the corresponding notch 530 permitting the container tray to slide (unsecure or opened configuration). When the sleeve is manually squeezed the container tray may slide completely out or if the user stops squeezing the sleeve will return to a resting configuration which may act to impede further movement. In the secure configuration, the container tray ends 540 cannot be pushed through the sleeve unless the user simultaneously squeezes one end of the sleeve and pushes the container tray through from the opposite side. To help prevent the sleeve 605 from being squeezed in the center and thus allowing the entire sleeve to ovalize and allowing travel in either direction at the same time, the container tray includes a bead 750 on the side walls 622 towards a middle region along the length $C_L$ thereof. If squeezed in the middle the bead impedes deformation, requiring the user to squeeze towards one end of the container tray assembly.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended claims, all such modifications within the scope of the appended claims.

I claim:

1. A container tray assembly configured to hold a substance comprising:

a container tray having a bottom terminating into a wall that extends to form upwardly extending end walls and upwardly extending side walls positioned between the end walls, the end walls and side walls form to surround an internal cavity, the container tray further having a groove and a flange positioned on the bottom and further positioned adjacent each end wall;

a sleeve having a sleeve wall extending from a first opened end to a second opened end, the sleeve further having a sleeve length less than a container tray length defined on a long axis of the container tray, the sleeve further having a pair of notches separately positioned adjacent the first and second opened ends to separately correspond to the flanges on the bottom of the container tray, such that when the container tray is inserted into the sleeve the flanges engage the corresponding notches to define a secure configuration that prevents movement of the container tray relative the sleeve; and the container tray being further configured to have a width less than an interior of the sleeve to define a gap along the side walls of the container tray length and wherein the sleeve is further made of a material configured to deform inwardly when an outside force squeezes the sleeve such that an inward deformation of the sleeve into the gap causes the flanges to move out of engagement with the corresponding notches to permit the container tray to slide into an unsecure configuration.

2. The container tray assembly of claim 1, wherein each groove and flange are positioned adjacent each other.

3. The container tray assembly of claim 2, wherein the each groove is further positioned closer to the upwardly extending end wall such that the flange is further positioned inwardly along a length of the container tray.

4. The container tray assembly of claim 1, wherein the container tray length is 2-3% longer than the sleeve length such that the end walls of the container tray extend past the first and second opened ends of the sleeve.

5. The container tray assembly of claim 1 further comprising a bead positioned on the side walls towards a middle region along the container tray length to permit squeezing of the sleeve only towards the first or second opened end.

6. A container tray assembly configured to hold a substance comprising:

a container tray having a bottom terminating into a wall that extends to form upwardly extending end walls and upwardly extending side walls positioned between the end walls, the end walls and side walls form to surround an internal cavity, the container tray further having a flange positioned on the bottom and further positioned adjacent each end wall;

a sleeve having a sleeve wall extending from a first opened end to a second opened end, the sleeve further having a sleeve length less than a container tray length defined on a long axis of the container tray, the sleeve further having a pair of notches separately positioned adjacent the first and second opened ends to separately correspond to the flanges on the bottom of the container tray, such that when the container tray is inserted into the sleeve the flanges engage the corresponding notches to define a secure configuration that prevents movement of the container tray relative the sleeve;

the container tray being further configured to have a width less than an interior of the sleeve to define a gap along the side walls of the container tray length and wherein the sleeve is further made of a material configured to deform inwardly when an outside force squeezes the sleeve such that an inward deformation of the sleeve into the gap causes the flanges to move out of engagement with the corresponding notches to permit the container tray to slide into an unsecure configuration; and a bead positioned on the side walls towards a middle region along the container tray length to permit squeezing of the sleeve only towards the first or second opened end.

7. The container tray assembly of claim 6 further comprising a groove positioned adjacent each flange.

8. The container tray assembly of claim 6, wherein the container tray length is 2-3% longer than the sleeve length such that the end walls of the container tray extend past the first and second opened ends of the sleeve.

9. The container tray assembly of claim 6 wherein each groove is further positioned closer to the upwardly extending end wall such that the flange is further positioned inwardly along a length of the container tray.

* * * * *